US006293213B1

(12) United States Patent
Block et al.

(10) Patent No.: US 6,293,213 B1
(45) Date of Patent: Sep. 25, 2001

(54) GUSSET MANUFACTURING MACHINE WITH AUTOMATED MEASURING AND CUTTING STATION

(75) Inventors: Paul Block, Nesconset; Michael Lydick, Medford, both of NY (US)

(73) Assignee: Galkin Automated Products Corp., West Babylon, NY (US)

( * ) Notice: Subject to any disclaimer, the term of this patent is extended or adjusted under 35 U.S.C. 154(b) by 0 days.

(21) Appl. No.: 09/655,565

(22) Filed: Sep. 6, 2000

(51) Int. Cl.[7] ..... D05B 11/00; D05B 21/00; D05B 25/00; D05B 33/02; D05B 37/04

(52) U.S. Cl. ..... 112/470.05; 112/130; 112/155; 112/2.1; 112/470.33; 112/470.36; 112/475.02; 112/475.06

(58) Field of Search ..... 112/470.05, 475.02, 112/475.06, 470.33, 470.36, 130, 141, 147, 155, 307, 2.1; 83/56, 350

(56) References Cited

U.S. PATENT DOCUMENTS

| | | | | |
|---|---|---|---|---|
| 3,773,002 | * | 11/1973 | Burton | 112/470.05 |
| 3,990,374 | | 11/1976 | Heidt . | |
| 4,893,574 | * | 1/1990 | O'Neal et al. | 112/475.06 |
| 5,816,177 | * | 10/1998 | Brocklehurst | 112/470.05 |

* cited by examiner

*Primary Examiner*—Peter Nerbun
(74) *Attorney, Agent, or Firm*—Keusey & Tutunjian, P.C.

(57) ABSTRACT

A method and apparatus for automatically cutting notches at specific locations on a web which are separated by predetermined lengths which are the outer dimensions of a pillowtop mattress. The web is pulled through a sewing station with a traction drive. Slack is induced in the web downstream of the traction drive. Predetermined lengths are drawn out of the slack bin in a single motion through a linear measuring device. A knife disposed in close proximity to the measuring device cuts the notches at the specific locations and subsequently severs the notched portion from the remainder of the web.

23 Claims, 5 Drawing Sheets

GUSSET MANUFACTURING MACHINE WITH AUTOMATED MEASURING AND CUTTING STATION

BACKGROUND OF THE INVENTION

1. Field of the Invention

The invention relates to a gusset manufacturing machine for producing pillowtop mattresses. More particularly, it relates to such a machine having an automatic measuring and cutting station for the corner notches.

2. Prior Art

Recently, the mattress industry has adopted pillowtop mattresses as the standard in their premium mattress lines. The pillowtop is essentially a cushioned pad attached to the upper surface of the mattress. To enhance the comfort and aesthetics of this design, the periphery of the pillowtop remains free from the edge of the mattress. Rather, the periphery of the pillowtop is secured to the upper flap of an inwardly-folded gusset. The lower flap of the gusset includes a flange, both of which are secured to the edge of the mattress. The flange extends inwardly past the gusset fold where it is secured to the mattress' spring unit.

Gusset construction consists of doubling-over and stitching the gusset material to create the fold line and sewing the flange material to the bottom flap of the gusset. To simplify this operation, certain prior art methods attach the flange material at the gusset fold line in a single operation. Ideally, the flange material is secured to the free end of the lower gusset flap. In either case, the material handling necessary for the folding, unfolding and joining operations, require the gusset and flange to be unspooled and sewn together in a continuous web. In a subsequent manual operation, needing a large workspace, the web is laid out and alternating length and width measurements are made along its length. At the end of each measured length, notches are cut into the web or cut as the gusset is being taped to the top panel. The edges of each notch are sewn together to form a corner. It would, therefore, be desirable to automatically measure and notch the web in a mechanized operation immediately following creation of the continuous web.

SUMMARY OF THE INVENTION

It is a primary object of the present invention to provide a measuring and cutting station in-line with the gusset and flange sewing operations.

It is a further object of the invention to continuously cut notches into the web and to severe completed gusset frames from the web.

It is another object of the invention to provide slack-induced sections of the web to the measuring and cutting station so that the web may be drawn and accurately measured without tension.

It is yet another object of the invention to provide a slack bin that is automatically filled by the upstream sewing stations.

These and other related objects are achieved according to the invention by a method and apparatus for automatically cutting notches at specific location on the web which are separated by predetermined lengths which define the outer dimensions of a pillowtop mattress. The web is pulled through a sewing station with a traction drive. Slack is induced in the web by downstream of the traction drive. One predetermined length is drawn out of the slack bin in a single motion through a linear measuring device. A knife disposed in close proximity to the measuring device cuts the notches at the specific locations. After all four predetermined lengths are measured and notched, the knife separates the notched section from the remainder of the continuous web.

In the first stage sewing operation, a first material is folded and a first seam is sewed along the folded edge. A second material is sewn to the first material along one of the free ends. The first and second sewing steps and the associated traction drive are synchronized to pull the web uniformly. After the sewing operation, the web is suspended to form a slack loop under the influence of gravity. A sensor within the slack bin generates a sensor output representative of the length of a slack loop. The output is evaluated to determine when additional slack needs to be generated. The traction drive is selectively operated within a feedback loop to control operation of the upstream sewing station.

Material from the slack bin is pulled without tension to measure a particular predetermined length. A cutting device positioned in close proximity to the linear measuring device cuts a notch into one side of the web. The notch may be formed with one V-shaped die cut or two knife cuts oriented at 90 degrees from each other. After one entire pillowtop gusset is notched, the same or a different knife severs the gusset from the remainder of the continuous web with a cut oriented approximately 90 degrees to the longitudinal direction of the web.

BRIEF DESCRIPTION OF THE DRAWINGS

In the accompanying drawings to which reference is made in the instance specification and which are to be read in conjunction therewith and which like reference characters are used to indicate like parts in the various views.

DETAILED DESCRIPTION OF THE PREFERRED EMBODIMENT

Figure 1:
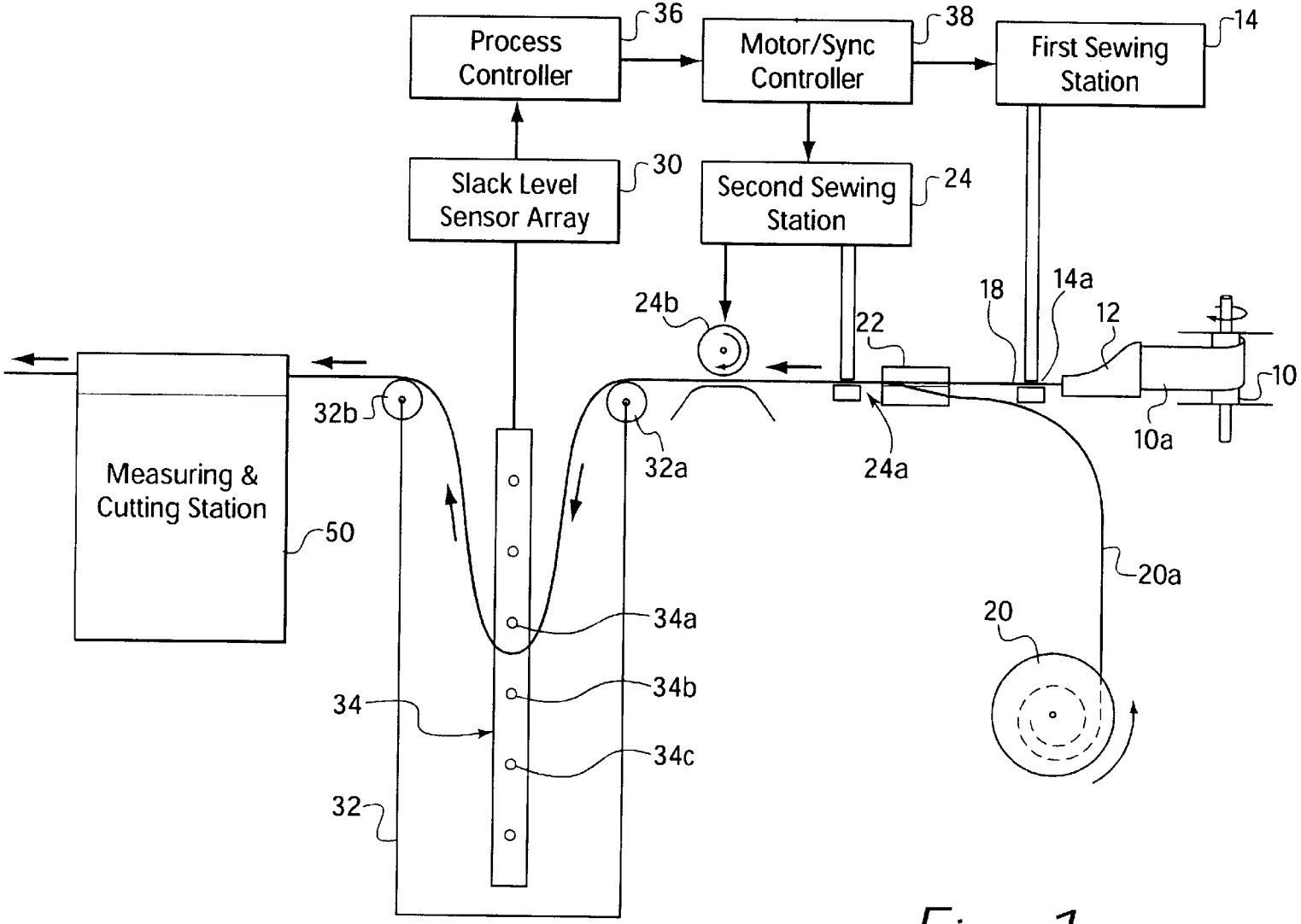
FIG. 1 is a schematic view of an embodiment of a gusset-forming machine according to the invention.

Referring now in detail to the Figures, and in particular FIG. 1 there is shown an embodiment of the gusset-forming machine according to the invention. To summarize, gusset material 10*a* and flange material 20*a* are subject to several sewing operations which result in the creation of a continuous folded gusset having flange secured to the lower flap thereof. The formed gusset with flange drops into a slack bin from which it can be drawn by the measuring and cutting station without tension. Before describing the gusset-forming machine in greater detail, an operational overview of the process will be provided by reference to FIG. 3. Please note that reference numerals from FIG. 1, for example, spool 10, have a corresponding operational step in FIG. 3, by incrementing the reference numeral by 100, i.e., step 110-Unspool material from the roll.

Figure 3:
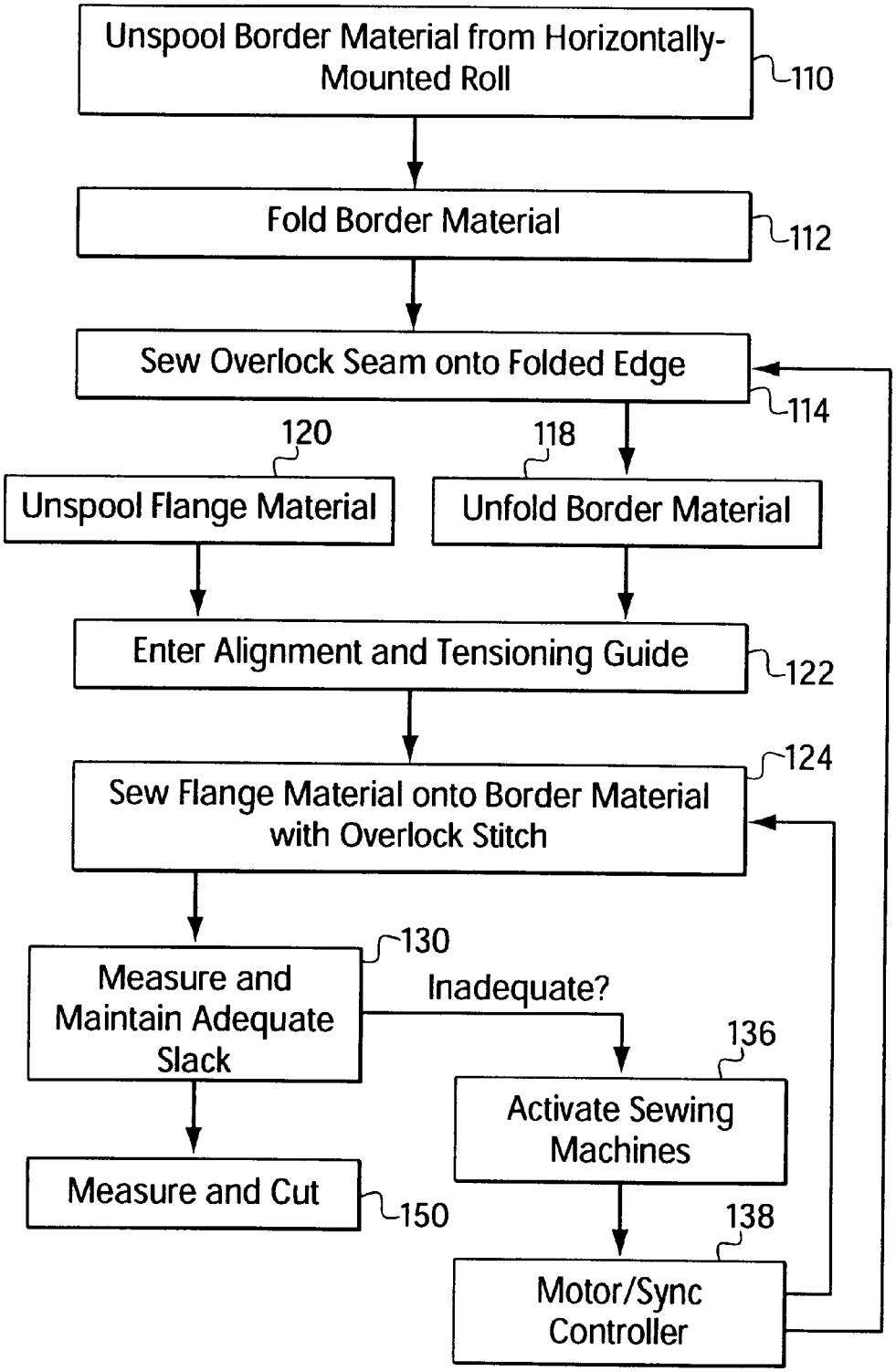
FIG. 3 is a flow chart outlining the operational steps of the gusset-forming machine.

As can be seen in FIG. 3 the first step 110 consists of unspooling border material from its roll. The border material is folded in step 112. For example, the border material may be folded in half along its length thereby defining a pair of overlying, longitudinally-extending free edges and a spaced opposite, longitudinally-extending folded edge. In step 114 an overlock seam is sewn onto the folded edge. The border material is unfolded in step 118 and joined with flange material 120 as they enter an alignment and tension guide 122. The flange material is sewn onto the free edge of the lower flap of the border material with an overlock stitch in step 124. The joined materials then enter a slack bin where it is measured to maintain adequate slack in step 130. Material is drawn, without tension, from the slack bin, where it is measured and notched in step 150. If inadequate slack is sensed in step 130, the upstream sewing machines are activated in step 136. In order to maintain the alignment and tension during the sewing operations, the sewing steps 114 and 124 are operated in tandem by motor/sync controller in step 138.

Figure 4:
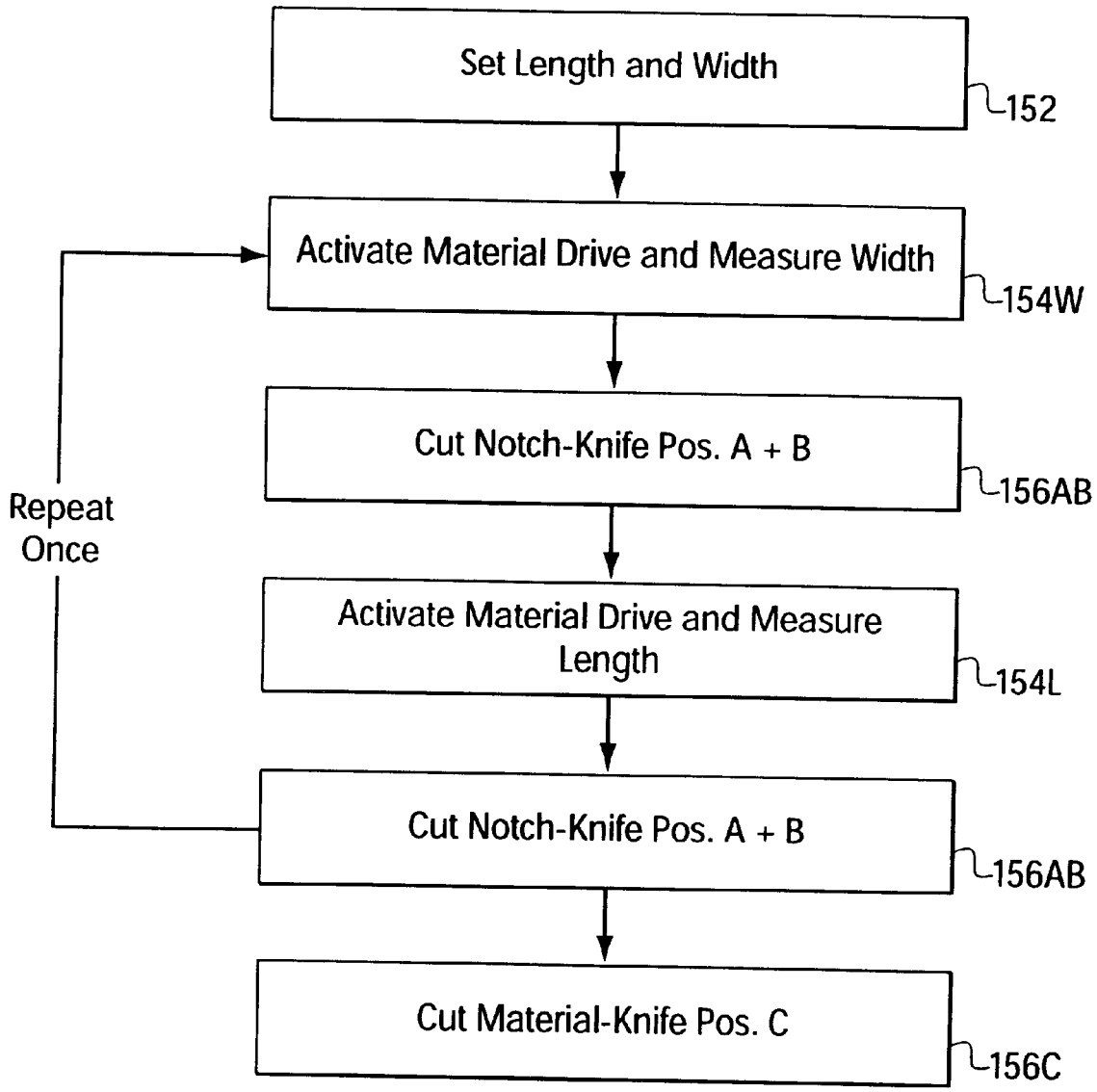
FIG. 4 is a flow chart outlining the operational steps of the measuring and cutting station.

The measuring and cutting step 150 is described in greater detail in FIG. 4. Initially the desired length and width of the pillowtop are set in step 152. The material drive is activated to draw the web out of the slack bin and the width is measured in step 154W. A notch is cut into the web at knife positions A and B in step 156AB. Parenthetically, if additional slack is required, steps 136 and 138 from FIG. 3 would be carried out independently of the measuring and cutting steps. The material drive is again activated and the length is measured out along the web in step 154L. A notch is cut into the web at knife positions A and B in step 156AB. To measure and cut the subsequent width and length sections, steps 154W and 156AB and 154L and 156AB are repeated once. Having measured all four sections of the gusset frame, the web material is cut completely through at knife position C in step 156C.

Referring now to the equipment of FIG. 1, roll 10 is mounted so that border material 10*a* spools off roll 10. Material web 10*a* enters a folding device 12 wherein the longitudinally-extending free ends of the material would meet, facing out of the page. The longitudinally-extended folded edge resulting therefrom would face into the page. Roll 10 is mounted so that the material feeds easily into folding device 12 without wrinkling or creasing, for example the material may spool off in a horizontal or near horizontal direction. A sewing machine 14*a* of first sewing station 14 sews an overlock seam at, or adjacent to, the longitudinally-extending folded edge. As material 10*a* exits first sewing station 14 at location 18, the upper flap is unfolded 180 degrees clockwise, as viewed along the direction web advancement.

An alignment and tensioning guide 22 includes a lower slot for receiving flange material 20*a* from a flange spool 20. The upper slot in guide 22 receives the unfolded border material. The far edges of the flange and border material, i.e., the edges extending into the page, are carefully aligned. The edges are also held under tension between drive wheel 24*b* and guide 22 to keep them flat and smooth. The flange and border material are sewn together at their aligned edges with an overlock stitch by a sewing machine 24*a* of second sewing station 24. The feed mechanism of sewing machine 24 is assisted by a positive drive wheel 24*b*.

The joined material falls under the influence of gravity into a slack bin 32 which includes roll guides 32*a* and 32*b*. A single sensing device or sensor block 34 is disposed vertically within slack bin 32. The output from sensor block 34 is identified as slack level sensor array 30. Array 30 provides an input to process controller 36 based on the slack level and rate of slack production and reduction. Process controller 36 provides control signals to a motor/sync controller 38 that provide synchronized operation of sewing stations 14 and 24 including uniform material advancement via the traction feeds of sewing machines 14*a* and 24*a* as well as traction wheel 24*b*. Second sewing station 24 may include internal synchronization of sewing machine 24*a* and traction wheel 24*b*. The synchronization of sewing machines 14*a* and 24*a* may be accomplished by the device specified in U.S. Pat. No. 3,990,374, entitled Contactless Synchronizer for Sewing Machines, the contents of which are incorporated herein by reference thereto.

As an example, assume that the slack within bin 32 should normally extend down to sensor 34*c*. If measuring and cutting station 50 draws material for a short section, the web is drawn out of the slack bin across sensor 34*b* whereby the slack level sensor array 30 signals process controller 36 to activate the sewing stations to provide more slack until the loop extends down passed sensors 34*b* and 34*c*. Alternatively, if measuring and cutting station 50 draws a large amount of slack, for example, for an extended length, the slack loop passes upwardly passed sensors 34*b* and 34*a*. In this instance, process controller 36 may perform an extended or faster synchronized sewing operation.

Figure 2A:
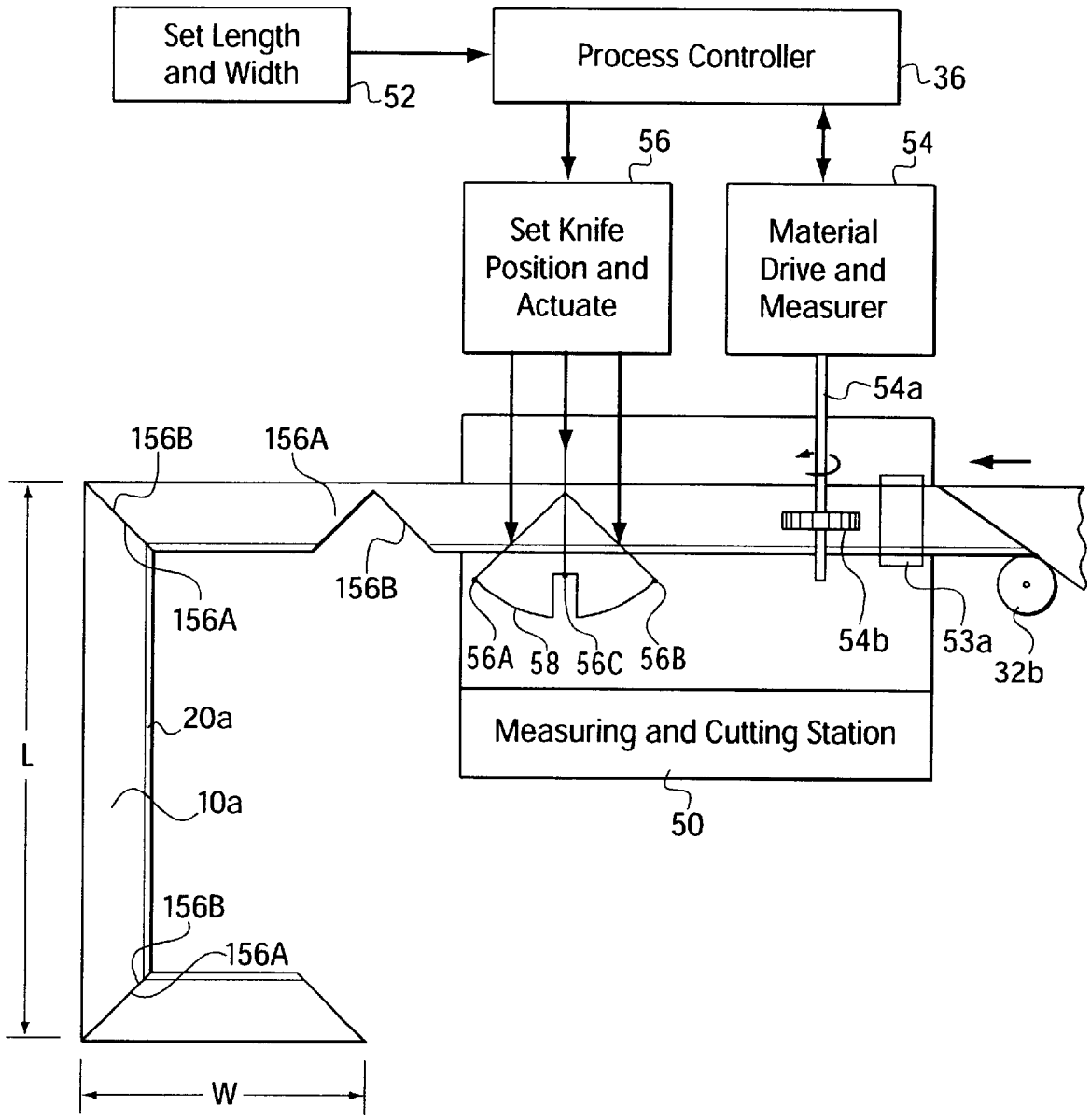
FIG. 2A is a top plan view of the measuring and cutting station.

The operation of measuring and cutting station 50 may be seen in greater detail with reference to FIG. 2A. Material drive and measurer 54 rotates an axle 54*a* which carries a traction drive 54*b* that draws material without tension from the slack bin through a guide 53*a* where the lower flap is folded 180 degrees clockwise, as viewed along the direction of web advancement. All measuring and cutting operations are based on the length and width of the mattress or pillowtop to be manufactured. These dimensions are fed to the process controller 36 via block 52. Once the width dimension is measured, the knife positioning and actuating device 56 cuts at position 56A. The knife then swings along arc 58 to position 56B to complete the first notch. The material drive and measurer 54 then draws a length section of web and additional cuts are made at positions 56A and 56B forming the second notch. After another width dimension is drawn and notched, the material drive and measurer 54 draws material for the final length dimension. FIG. 2A illustrates the configuration at this point. At the final corner after the notch is cut, the knife is oriented perpendicular to the web and indexed forward to position 56C to sever the notched portions from the web.

As can be seen in FIG. 2A adjacent length and width portions are rotated 90 degrees toward each other to form a structure resembling a picture frame. The edges denoted as 156A are joined to the facing edges 156B in a subsequent sewing operation, leaving a frame whose outer perimeter is closely matched to the outer perimeter of the mattress. The flange material 20*a* extends into the center of the frame and may be attached to an inner panel which applies tension like a trampoline, to all four inside edges of the border material. This draws the inside, folded edge of the border material inwardly to eliminate any wrinkles or pleats in the material along the perimeter of the frame. This frame can be attached to the underside of a quilted mattress panel using a blind stitch machine, by sewing an inner perimeter of the frame to the foam underside of the panel.

Figure 2B:
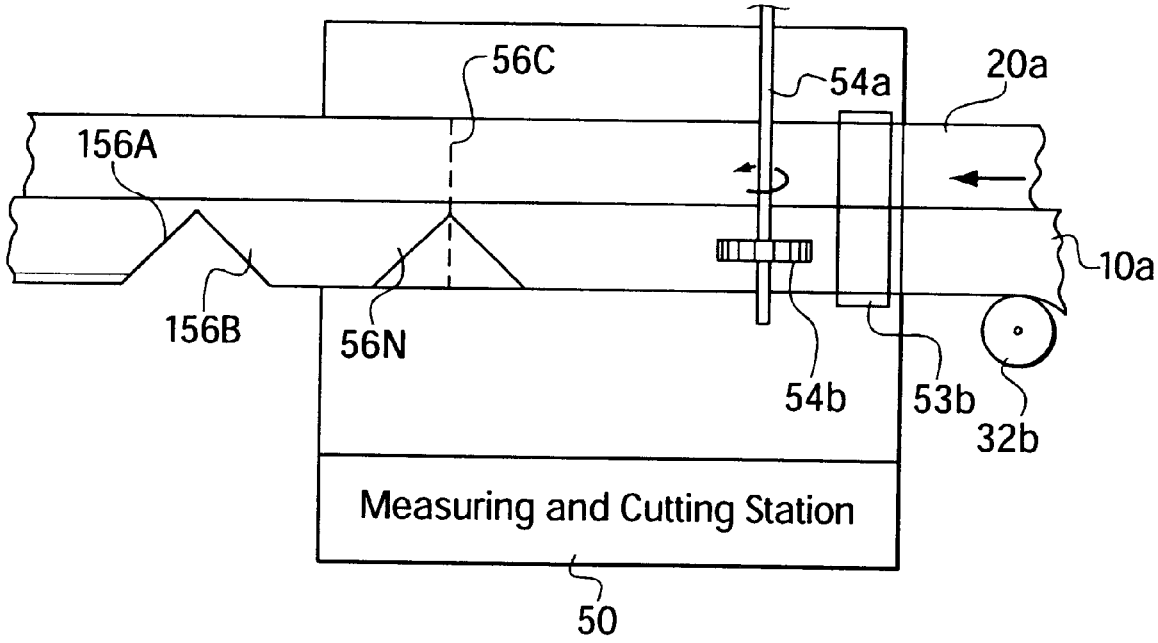
FIG. 2B is a top plan view of an alternate embodiment of the measuring and cutting station.

FIG. 2B shows an alternate embodiment for notching the border material 10*a* only and leaving the flange material 20*a* unnotched. Guide 53*b* is extended in the direction perpendicular to the longitudinal direction of the web to spread flange 20*a* away from border 10*a*. The notch is cut into border 10*a* only, for example, with a single die cut along the V-shaped line 56N. To sever the notched portions from the remainder of the web, the severing cut line 56C must now extend twice as far to cut across both materials 10*a* and 20*a*. The flange material, which is relatively lightweight and thin compared to the border material, is bunched up at the corners and provides additional surface area for attachment to the mattress. It should be noted that regardless of whether the flange is cut, the notches may be made by one or two knives of various types, for example, guillotine knives, roll dies or any other type known to those skilled in the art of textile manufacturing and processing. The only requirement is that the knives do not interfere with the accurate measurements of the length and width portions. The final severing cut may be made with the same or a different knife than the one used for the notches.

As will be readily apparent to those skilled in the art, the gusset-forming machine of the invention achieves the stated objectives by providing an automated measuring and cutting station. The measuring operation is performed accurately by drawing the web without tension with a positive traction drive. Once the sections are measured, notches are cut by utilizing the A and B perpendicular positions of the knife. After the notches are completed for a particular pillowtop, the knife is actuated at its center position C to sever the pillowtop gusset from the web. Material is provided to the measuring and cutting station 50 without tension due to the provision of a slack bin disposed directly upstream. The slack bin is equipped with sensors that provide control signals to generate additional slack from upstream sewing operations. The web entering the slack bin is formed in a sequential operation requiring careful alignment and tensioning of the border and flange materials. By providing an alignment and tensioning guide 22, and a positive traction drive 24*b*, the folding, sewing, joining and the unfolding of the material is carefully controlled.

What is claimed is:

1. A method for automatically cutting notches at predetermined lengths along a longitudinally-extending web traveling in a downstream direction comprising the steps of:

pulling the web with a traction drive through a sewing station;

inducing slack in a section of the web downstream of said traction drive; and drawing a predetermined length of a slack section in a single motion through a linear measuring device and cutting a notch therein.

2. The method of claim 1, wherein said pulling step comprises:

folding a first material to form a longitudinally-extending folded edge and first sewing a first seam along the folded edge; and second sewing a second material to the first material with a second seam, wherein said first and second sewing steps and said traction drive are synchronized to pull the web uniformly.

3. The method of claim 1, wherein said inducing step comprises maintaining a specified amount of slack web which exceeds a longest predetermined length.

4. The method of claim 3, wherein said maintaining step comprises:

generating a control signal representing the amount of slack web needed; and selectively operating the traction drive in response to said control signal to induce additional slack;

wherein said control signal comprises a feedback loop which controls operation of the upstream pulling step.

5. The method of claim 4, wherein said inducing step comprises suspending the web to form a slack loop under the influence of gravity and wherein a sensor generates a sensor output representative of the length of the slack loop; and wherein said generating step comprises comparing the sensor output to the specified amount of slack to establish the control signal.

6. The method of claim 1, wherein said cutting step comprises:

running the predetermined length of slack section past an articulated knife;

first slicing partly across the web at a first angle to the longitudinal direction;

pivoting the articulated knife; and second slicing partly across the web at a second angle to the longitudinal direction.

7. The method of claim 6, wherein the first slice and the second slice intersect thereby removing a wedge of material from the web.

8. The method of claim 6, wherein said cutting step further comprises:

pivoting the articulated knife to a position between said first angle and said second angle; and third slicing completely across the web.

9. The method of claim 8, wherein the intersection of the first angle and the second angle define a notch angle, and wherein the third slice bisects the notch angle.

10. The method of claim 9, wherein the notch angle is approximately 90 degrees and the third slice is approximately perpendicular to the longitudinal direction.

11. An apparatus for sewing and for automatically cutting notches at predetermined lengths along a longitudinally-extending web traveling in a downstream direction comprising:

a sewing station including a traction drive;

a slack bin downstream of said traction drive;

a linear measuring device for drawing a predetermined length of web from said slack bin in a single motion; and a cutting device for notching the drawn web.

12. The apparatus of claim 11, wherein said sewing station comprises:

a first sewing machine for sewing a first seam along a longitudinally-extending folded edge of a first material;

a second sewing machine for sewing a second material to the first material; and means for synchronizing the first and second sewing machines with said traction drive to uniformly pull the web.

13. The apparatus of claim 11, wherein said slack bin includes spaced-apart supports to suspend the web therebetween under the influence of gravity.

14. The apparatus of claim 11, comprising a sensor for generating a sensor output representative of the amount of slack web within said bin.

15. The apparatus of claim 14, comprising a controller programmed to maintain a specified amount of slack web within said bin, said controller comparing the sensor output to the specified amount to generate a control signal, which operates said traction drive in a feedback loop.

16. The apparatus of claim 11, comprising a controller coupled to said cutting device, wherein said controller is programmed to partially slice across the web at two different angles to remove a wedge of material from the web.

17. The apparatus of claim 16, wherein said controller is further programmed to slice completely across the web at a further angle, wherein said further angle falls in between said two different angles.

18. The apparatus of claim 17, wherein the intersection of said two different angles defines a notch angle and wherein the further angle bisects the notch angle.

19. The apparatus of claim 18, wherein said further angle is approximately perpendicular to the longitudinal direction.

20. The apparatus of claim 11, wherein said cutting device comprises a knife which pivots along an arc to slice the web at different angles.

21. The apparatus of claim 20, wherein said knife includes three discrete positions along the arc for slicing the web at 45 degrees, 90 degrees and 135 degrees relative to the longitudinal direction.

22. The apparatus of claim 21, wherein in the 45 degree and 135 degree positions the knife extends partially across the web.

23. The apparatus of claim 21, wherein in the 90 degree position, said cutting device is indexed so that the knife extends completely across the web.

* * * * *